US006401640B2

(12) United States Patent
Tanaka

(10) Patent No.: US 6,401,640 B2
(45) Date of Patent: Jun. 11, 2002

(54) SEWING MACHINE WITH LOOP RETAINER

(75) Inventor: Yoshiyuki Tanaka, Toyonaka (JP)

(73) Assignee: Yamato Mishin Seizo Kabushiki Kaisha, Osaka (JP)

( * ) Notice: Subject to any disclaimer, the term of this patent is extended or adjusted under 35 U.S.C. 154(b) by 0 days.

(21) Appl. No.: 09/845,321

(22) Filed: May 1, 2001

(30) Foreign Application Priority Data

May 2, 2000 (JP) ..... 2000-133869

(51) Int. Cl.[7] ..... D05B 61/00
(52) U.S. Cl. ..... 112/200
(58) Field of Search ..... 112/197, 199, 112/200, 187

(56) References Cited

U.S. PATENT DOCUMENTS 3,753,410 A * 8/1973 Kostenowczyk ..... 112/199
4,643,114 A * 2/1987 Hampel et al. ..... 112/199
4,974,534 A * 12/1990 Eberhahn et al. ..... 112/199
5,769,018 A * 6/1998 Nakano ..... 112/200

FOREIGN PATENT DOCUMENTS

JP 58-124477 7/1983

* cited by examiner

*Primary Examiner*—Ismael Izaguirre

(57) ABSTRACT

The invention provides a sewing machine which comprises needle 1 that moves up and down while sticking into a cloth W on a needle plate and a looper 2 that projects and withdraws under the needle plate so that the looper 2 projects to catch a needle thread 10 left under the needle plate in accordance with the rise of the needle 1 and draw out the thread in accordance with the feeding of the cloth W, and on the other hand, the needle 1 falls to catch the looper thread left under the needle plate upon the withdrawal of the looper 2, whereby multi-thread chain stitches or covering stitches are formed, wherein a retainer rod 30 is provided which projects and withdraws backward and forward within a plane roughly in parallel with the feed surface of the cloth W while interlocked with the rise and fall of the needle 1, and this retainer rod 30 catches the looper thread 20 at the projection side of the looper 2 ahead of the needle 1 when projecting rearward, and holds the caught looper thread 20 between the rod and needle 1 under tension.

2 Claims, 4 Drawing Sheets

SEWING MACHINE WITH LOOP RETAINER

BACKGROUND OF THE INVENTION

Field of the Invention

The present invention relates to a sewing machine such as a multi-thread chain stitch sewing machine, covering sewing machine, safety stitch sewing machine, or the like to perform sewing by means of a needle that moves up and down while sticking into a cloth on a needle plate and a looper that projects and withdraws laterally under the needle plate.

The multi-thread chain stitch sewing machine has one needle or a plurality of needles that hold a needle thread and move up and down while sticking into a cloth on a needle plate. Furthermore, the multi-thread chain stitch sewing machine has a looper that holds a looper thread and projects and withdraws laterally under a needle plate. This multi-thread chain stitch sewing machine operates as follows. First, when a needle thread is sent out by a fall of the needle and the movement of the needle is converted into a rise, the multi-thread chain stitch sewing machine operates so that the looper catches the loop of the needle thread left under the needle plate in synchronization with this rise.

Second, the multi-thread chain stitch sewing machine draws out the loop of the needle thread caught by the looper upon feeding a cloth back or forth on the needle plate. Third, when changing the looper so as to withdraw, the multi-thread chain stitch sewing machine catches the loop of the looper thread left by the needle that moves down in synchronization with the withdrawal. The multi-thread chain stitch sewing machine repeats these operations in order.

The covering stitch sewing machine performs such sewing operation in the same manner. The safety stitch sewing machine performs over-edge chain stitching on the edge of a cloth, and at the same time, performs the abovementioned multi-thread chain stitching along one side of the over-edge chain stitch.

FIG. 3 and FIG. 4 are plan views of the multi-thread chain stitches viewed from the back surface side of a cloth to be sewn. As shown in the figures, the looper thread 20 is caught in the loop of needle thread 10 that is exposed to the back surface of the cloth W at predetermined intervals corresponding to the amount of movement of the cloth W.

In the figures, the white arrows with black outlines show the direction of feeding of the cloth W. The needle thread 10 and looper thread 20 are intertwined with each other at a stitch by inserting the looper thread 20 into one loop (rear loop) of the needle thread 10 from the rear side of the direction of feeding. Then, the intertwined portion is passed through the front portion of the loop (front loop) adjacent to the rear loop and returned to the rear side. Thereafter, the intertwined portion is inserted into the rear loop again and turned back. Last, the intertwined portion is inserted into the front loop from the rear side of the direction of feeding. These processes are repeated, and then the intertwined portions form double rings formed of the looper thread 20 across the front loop and rear loop that are formed of needle thread 10 adjacent to each other in the direction of feeding.

The difference between the stitches shown in FIG. 3 and FIG. 4 arises due to the balance in tension between the needle thread 10 and looper thread 20. In the case where the tension of the needle thread 10 is increased to be greater than that of the looper thread 20, due to the tension of the needle thread 10 toward the surface side of the cloth W, the inserted portion of the looper thread 20 is strongly tightened. As a result, as shown in FIG. 3, a stitch in which the double rings stretch between the rear loop and front loop of the needle thread 10 is obtained.

To the contrary, in the case where the tension of the needle thread 10 is weakened to be less than that of the looper thread 20, the looper thread 20 is pulled against the relatively week tightening by the needle thread 10. As a result, as shown in FIG. 4, the double rings formed of the looper thread 20 stretch between the rear loop and front loop of the needle thread 10 and form a stitch in which the double rings overlap each other.

Such a form of stitches is selected depending on the kind of the cloth W to be sewn and sewing conditions such as a sewing portion. For example, to sew a thick cloth with high rigidity such as denim or the like, the stitch shown in FIG. 4 is selected in many cases in order to realize firm sewing without looseness. On the other hand, to sew a thin cloth with flexibility such as a cloth for a shirt, the stitch shown in FIG. 3 is selected in order to obtain a smooth texture.

However, to obtain the stitch shown in FIG. 3, as mentioned above, the tension of the needle thread 10 must be increased to be greater than that of the looper thread 20. If this is realized by increasing the tension of the needle thread 10, the cloth itself is tightened due to the high tension of the needle thread 10. Then, surface wrinkles called puckering occurs on the cloth after being sewn. Thereby, the finishing quality deteriorates.

To the contrary, in the case where the stitch is realized by reducing the tension of the looper thread 20, the looper thread sent out by the looper become loose. Then, it fails to catch the looper thread 20 when the needle moves down. Thereby, skip stitch occurs and the finishing quality deteriorates.

In order to solve the above problems and stably obtain the stitch shown in FIG. 3, a sewing machine provided with a retainer needle has been conventionally made practicable. This retainer needle is mounted together with a sewing needle to the needle bar so as to be positioned closer to the projection side of the looper than the sewing needle. The retainer needle reaches the position under the needle plate prior to the sewing needle when the needle bar moves down. On the other hand, the retainer needle comes out from the position under the needle plate after the sewing needle when the needle bar moves up.

According to this construction, the looper thread 20 sent out by the projection of the looper is caught by the retainer needle which reaches the position under the needle plate prior to the needle at the projection side of the looper ahead of the needle (in the case where a plurality of needles are provided, outside the outermost needle). The needle moves up in synchronization with the next projection of the looper, and this catch is maintained until the tightening by the needle thread 10 is started. This result is shown in FIG. 3. Between the front and rear loops of the needle thread 10 to be exposed to the back surface of the cloth W, the double rings of the looper thread 20 gradually spread. Then, a stitch is stably formed. It becomes unnecessary to adjust the tension of the needle thread 10 and looper thread 20. Furthermore, sewing failures such as the abovementioned puckering and skip stitch do not occur.

Thus, the sewing machine with a retainer needle has a simple structure in which the retainer needle is only attached to the needle bar for moving the needle up and down. In addition, the sewing machine with a retainer needle can stably perform multi-thread chain stitching (including safety stitching) or covering stitching regardless of the kind of the sewing cloth.

However, the retainer needle is constructed so as to reach the position under the needle plate by penetrating the cloth W together with the needle to catch the looper thread 20. When sewing by such a sewing machine with a retainer needle, as shown in FIG. 3, holes H, H . . . caused by penetration of the retainer are formed in line along one side of the multi-thread chain stitch (the projection side of the looper). Therefore, for uses requiring high finishing quality, the existence of these holes comes into question.

Recently, in order to make ironing after washing unnecessary, sewn products (such as shirts, handkerchiefs, and others) using shape-memory cloth have been made practicable. In the case where a sewing machine with a retainer needle is used for sewing each portion of such a type of cloth, the abovementioned holes H, H . . . are left as unnecessary traces keeping their form when they are formed. Therefore, an excellent finishing quality cannot be obtained.

BRIEF SUMMARY OF THE INVENTION

The present invention is made in order to solve the above problems. The object of the invention is to provide a sewing machine which can form a multi-thread chain stitch or covering stitch in which the looper thread is intertwined well with the needle thread on the back surface of a cloth without undesirable traces. Also, the object of the invention is to provide a sewing machine that can stably obtain sewn products of a good quality.

The sewing machine according to the first aspect of the invention comprises one needle or a plurality of needles that hold a needle thread and move up and down at a predetermined stroke penetrating of a needle plate; a looper that holds a looper thread, projects and withdraws laterally under the needle plate, and catches the needle thread left at the down position of the needle when the looper projects; and a retainer that moves forward and rearward within a plane under and roughly in parallel with the needle plate, and when moving rearward, crosses the travel path of the looper and catches the looper thread held by the looper at the projection side of the looper ahead of the needle.

In the sewing machine according to the first aspect of the invention, the retainer, which moves forward and rearward within a plane roughly in parallel with the needle plate while interlocked with the rise and fall of the needle and the lateral movement of the looper, is disposed under the needle plate. That is, in the first aspect of the invention, a retainer is disposed which moves without interference with the movements of the needle and looper and without an influence on a cloth on the needle plate. This retainer catches the looper thread at the projection side of the looper ahead of the needle when moving rearward. The retainer keeps this catch until it withdraws forward. The retainer maintains the looper thread under tension, and tightens the needle thread. Thereby, the sewing machine of the invention stably obtains stitches in which the looper thread intertwines with the needle thread in a loose condition without traces left on the cloth.

In the sewing machine according to the second aspect of the invention, the retainer according to the first aspect of the invention comprises a retainer base that is disposed under the needle plate and swings backward and forward in accordance with power transmission from the sewing machine's main shaft; and a retainer rod that is fixed at the base part on said retainer base and curves under the lower surface of the needle plate.

According to the second aspect of the invention, a retainer base is constructed so as to swing backward and forward in accordance with power transmission from the sewing machine's main shaft. The retainer rod that curves at a proper radius of curvature is provided on the retainer base. The retainer rod is provided on the retainer base with its curved portion shaped along the lower surface of the needle plate. The retainer is comprised of this retainer base and retainer rod. In the second aspect of the invention, the retainer base is made to swing, and the retainer rod is made to project and withdraw to catch the looper thread and release the catch. Furthermore, in the second aspect of the invention, the entire retainer including the retainer base and the retainer rod is disposed within a limited space such as the inside of a cylindrical bed under the needle plate. Thereby, the second aspect of the invention can be applied to models in which the space under the needle plate is limited.

In the sewing machine according to the third aspect of the invention, the timing of operation of the retainer according to the first or second aspect of the invention is set so that the condition where the looper thread is caught due to the rearward movement is maintained at least until the tip end of the looper that projects in accordance with the rise of the needle crosses the travel path of the needle.

In the invention, by the operation of the retainer at the abovementioned timing of operation, the needle thread is securely tightened before tightening the looper thread. Thereby, the third aspect of the invention correctly realizes stitches in a condition where the looper thread is loose.

The above and further objects and features of the invention will more fully be apparent from the following detailed description with accompanying drawings.

DESCRIPTION OF THE PREFERRED EMBODIMENTS

Figure 1A:
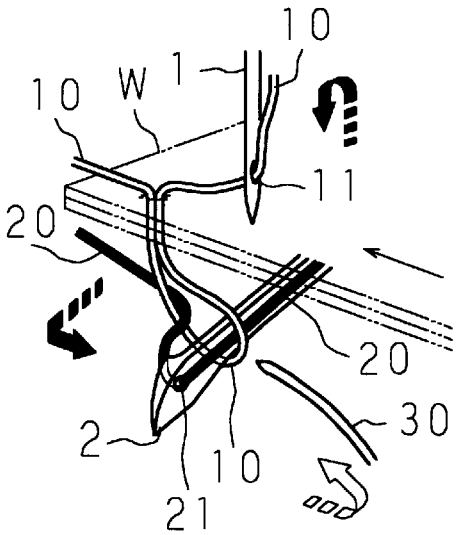
FIGS. 1A through 1D are explanatory views of the sewing operation showing an embodiment of the sewing machine of the invention.

Hereinafter, the invention is explained in detail based on the drawings showing embodiments of the invention. FIGS. 1A through 1D are explanatory views of the sewing operation of the sewing machine of the invention. In the description below, a sewing machine is described which performs multi-thread chain stitching on the cloth W fed on needle plate 14 (see FIG. 2 and FIG. 3) by using one needle 1 and looper 2, however, the invention is also applicable to sewing machines which perform multi-thred chain stitching by using a plurality of needles 1, 1 . . . and looper 2, safety stitching, or covering stitching by using a plurality of needles 1, 1 . . . and looper 2.

The needle 1 moves up and down at a predetermined stroke including the feed region of the cloth W on the needle plate 14. The looper 2 projects and withdraws in the direction roughly orthogonal to the direction of the rise and fall of the needle 1 and the direction of feeding of the cloth W under the needle plate 14. The arrow in the figure shows the direction of feeding of the cloth W. In the description hereinafter, the downstream side of this direction of feeding (the left in the figure) is regarded as the rear side, and the upstream side (the right in the figure) is regarded as the front side. The movement of the needle one is referred to as rise and fall.

Furthermore, the looper 2 is disposed on the right of the needle 1 with respect to the direction of feeding. The looper 2 projects leftward with respect to the direction of feeding. In the description hereinafter, the movements of the looper 2 refer to projecting leftward and withdrawing rightward. The looper 2 withdraws rightward with respect to the direction of feeding. The actual leftward projection and rightward withdrawal of the looper 2 accompanies forward and rearward movements. The movement of the looper 2 is generated along the orbit of the ellipse including the position of the rise and fall of the needle 1 inside. The looper 2 projects leftward passing through the rear side of the needle 1. The looper 2 withdraws rightward passing the front side of the needle 1. The looper 2 may be disposed on the left side of the needle 1, on the opposite side of the illustration in the figure. In this case, the looper 2 projects rightward and withdraws leftward.

A thread hole 11 is made in the needle 1, which penetrates the portion near the tip end (lower end) of the needle from the front to the back. Needle thread 10 guided from the upper side is inserted and held in the thread hole 11 from the front side. The needle thread 10 is let out under the needle plate 14 upon penetrating the cloth W in accordance with the fall of the needle 1. Thread hole 21 is made in the looper 2 so as to penetrate the portion near the tip end (left end) from the front to the back. Looper thread 20 guided from the right side is inserted and held in the thread hole 21 from the front side. The looper thread 20 is let out in accordance with the leftward projection of the looper 2.

The sewing machine of the invention comprises, in addition to the needle and looper 2 which move as described above, retainer 3 (see FIG. 2) constructed as described below using the side under the needle plate 14 (under the cloth W) as the region of movement.

In FIGS. 1A through 1D, retainer rod 30 that serves as a function part of the retainer 3 is shown. The retainer rod 30 is a member having a round bar shape with a small diameter that curves at a large radius of curvature. The retainer rod 30 is disposed so that its lengthwise direction is directed in the direction of feeding along the lower surface of the needle plate 14, that is, the back surface of the cloth W. The retainer rod 30 projects and withdraws in its lengthwise direction, that is, the direction of feeding within a plane roughly in parallel with the needle plate 14. In the description hereinafter, the rearward movement of the retainer rod 30 to catch the looper thread 20 is regarded as a projection. To the contrary, the forward return movement is regarded as a withdrawal.

The movements of the looper 2 and retainer 3 (retainer rod 30) are performed by power transmission from the sewing machine's main shaft (not shown) in accordance with the rise and fall of the needle 1. The looper 2 projects and withdraws in the same direction as that of the rise and fall of the needle 1. The looper 2 projects leftward in synchronization with the rise of the needle 1 and withdraws rightward in synchronization with the fall of the needle 1. On the other hand, the projection and withdrawal of the retainer rod 30 are generated in reverse to the direction of the rise and fall of the needle 1 and the direction of the projection and withdrawal of the looper 2. The retainer rod 30 withdraws in synchronization with the rise of the needle 1 (leftward projection of the looper 2) and projects in synchronization with the fall of the needle (rightward withdrawal of the looper 2).

FIG. 1(A) shows the condition where the looper 2 is at the end of leftward projection. At this time, the needle 1 starts to move down from the upper dead point. The retainer rod 30 is at the illustrated withdrawn position, and starts to project rearward. The looper 2 at the end of leftward projection holds the loop of the needle thread 10 caught in the process of leftward projection. This needle thread 10 is drawn out as shown in the figure by the feeding applied to the cloth W during the rise of the needle 1.

Figure 1B:
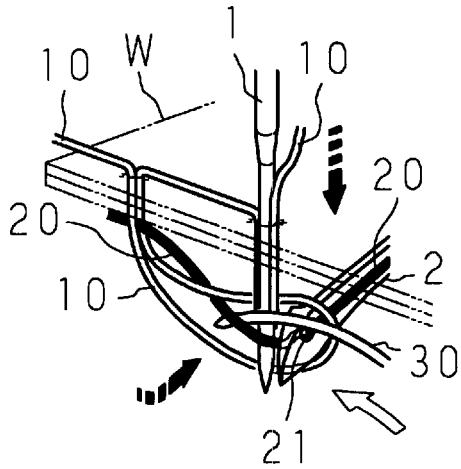

The looper 2 starts to withdraw rightward accompanying predetermined movement forward after reaching the end of leftward projection. FIG. 1(B) shows the condition after the looper starts to withdraw rightward. The needle 1 starts to move downward before the looper 2 withdraws rightward. As shown in the figure, the needle 1 reaches the position under the needle plate 14 upon penetrating the cloth W. Then, the needle 1 enters the loop of the looper thread 20 formed at the rear side of the looper 2 that is in withdrawing rightward at the left side of the needle thread 10 held by the looper 2. The retainer rod 30 that projects in accordance with the fall of the needle 1 crosses the tip end part of the looper 2 that withdraws as shown in the figure. The retainer rod 30 reaches the rear side of the looper 2. Then, the retainer rod 30 catches the loop formed of the looper thread 20 at the left side ahead of the needle 1 (projection side of the looper 2).

Figure 1C:
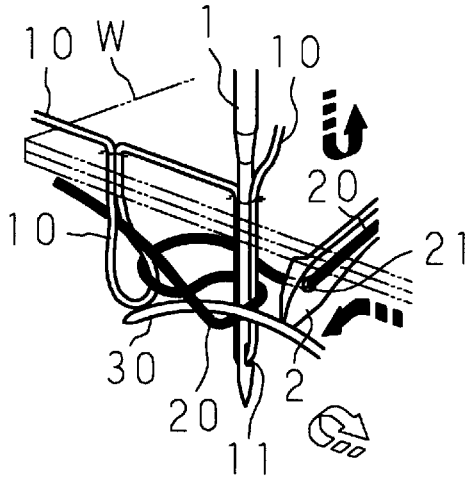

The loop of the needle thread 10 held by the looper 2 is released at the stage where the looper 2 properly withdraws rightward. The looper thread 20 that is doubly inserted in this loop is tightened by tension applied to the needle thread 10. During this, the retainer rod 30 is in the projected condition. The retainer rod 30 keeps holding the looper thread 20 that has been caught. FIG. 1(C) shows the condition where the retainer rod 30 has reached the portion near the end of the rearward projection. As shown in the figure, the retainer rod 30 keeps holding the looper thread 20 at the left side of the needle 1 near the lower dead point. The looper thread 20 is drawn out from the looper 2 at the position of the rightward withdrawal.

Figure 1D:
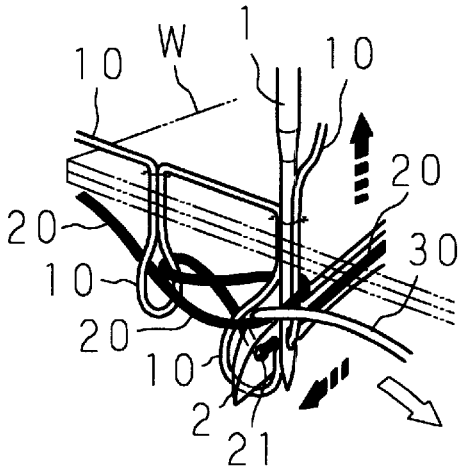

Thereafter, the looper 2 changes its movement to project leftward accompanying the rearward movement. Also, the needle 1 changes its movement and moves up. The movement of the retainer 30 changes into withdrawal to return forward. The leftward projection of the looper 2 is performed at the rear side of the needle 1. In accordance with the rise of the needle 1, the loop of the needle thread 10 formed at the rear side is caught by the looper 2 that projects leftward as shown in FIG. 1(D). The looper thread 20 held by the retainer rod 30 at the left side of the needle 1 is released in accordance with the subsequent withdrawal of the retainer rod 30. The looper thread 20 is laid across the loop (front loop) of the needle thread 10 caught by the looper 2 and the loop (rear loop) of the needle thread 10 released from the looper 2.

Figure 3:
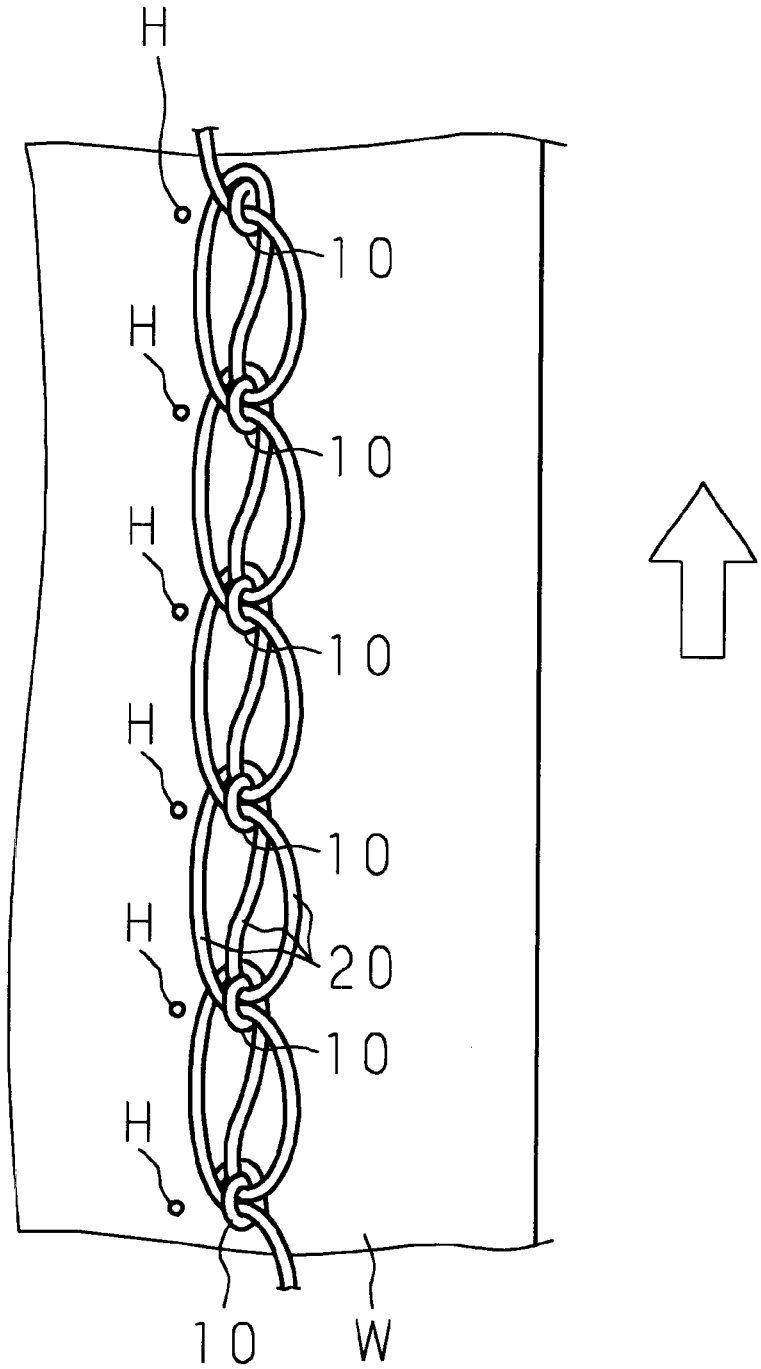
FIG. 3 is a plan view of the stitch obtained by means of multi-thread chain stitching when viewed from the back surface side of the cloth.
Figure 4:
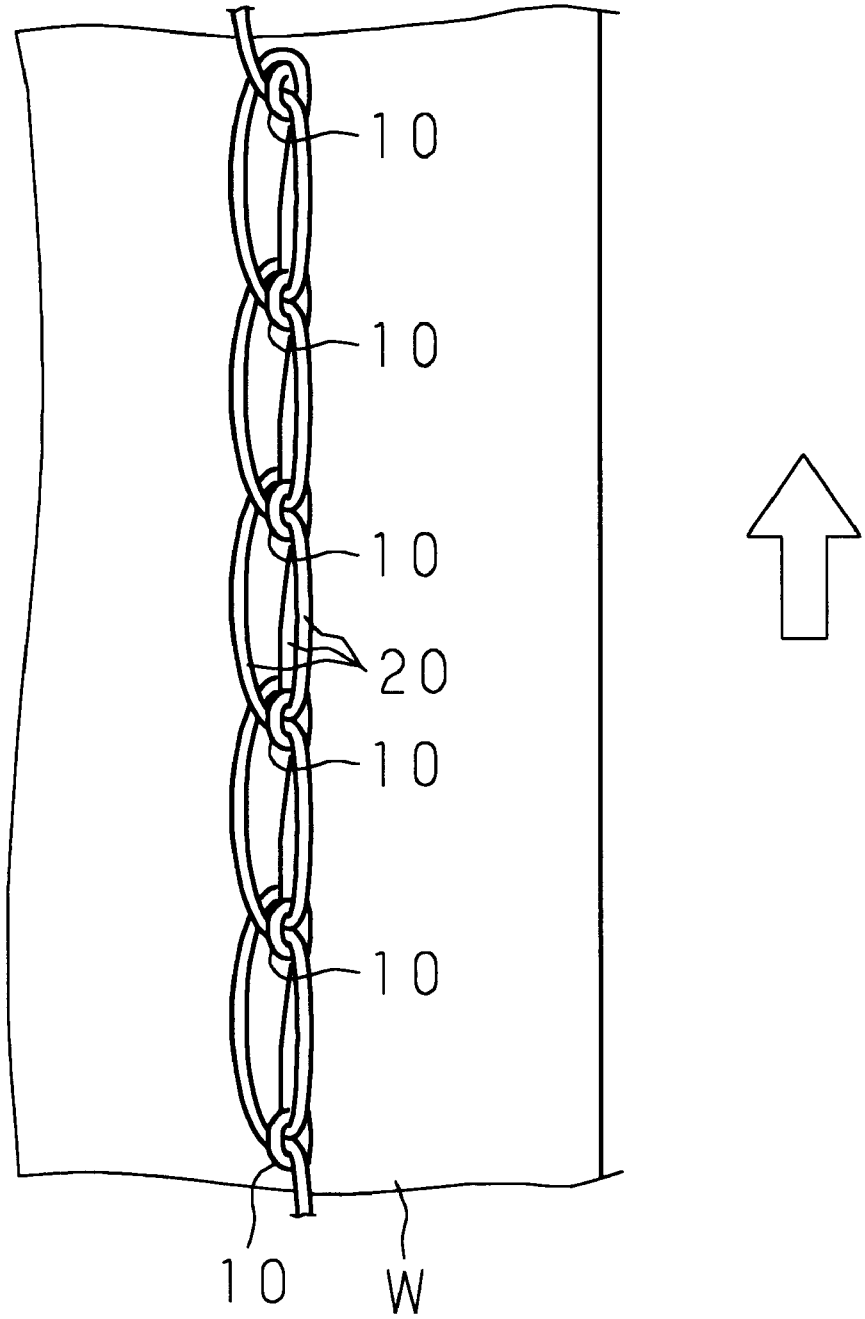
FIG. 4 is a plan view of the stitch obtained by means of multi-thread chain stitching when viewed from the back surface side of the cloth.

In FIG. 1(C) and FIG. 1(D), to make the relationship between the needle thread 10 and looper thread 20 clear, these threads are shown as if they are loosened. However, the rear loop of the needle thread 10 released from the looper 2 that withdraws rightward is tightened by the tension applied to the needle thread 10 before transition to the condition of FIG. 1(C). Therefore, after the condition in FIG. 1(D), the looper thread 20 is released in accordance with the withdrawal of the retainer rod 30 after tightening the rear loop. Therefore, the stitch is formed by the abovementioned operations as shown in FIG. 3. That is, the stitch becomes a desirable form in which the double rings of the looper thread 20 are loosely passed across the front and rear loops of the needle thread 10.

In the sewing machine relating to the invention, the retainer rod 30 for retaining the looper thread 20 acts within an region of action under the needle plate 14 that serves as the feed surface for the cloth W. Therefore, operation traces like the holes H, H . . . shown in FIG. 3 are not left on the cloth W, so that the improvement in the finishing quality is achieved. In addition, the retainer rod 30 crosses the travel path of the looper 2 when projecting rearward within the plane roughly in parallel with the needle plate 14. In addition, the retainer rod 30 is constructed so as to catch the looper thread 20 held by the looper 2. The looper 2 changes position to the front side, that is, in reverse to the direction of projection of the retainer rod 30 before starting to withdraw rightward. Therefore, the looper thread 20 is securely caught between the retainer rod 30 and looper 2 that cross each other while moving in directions opposite to each other.

Figure 2:
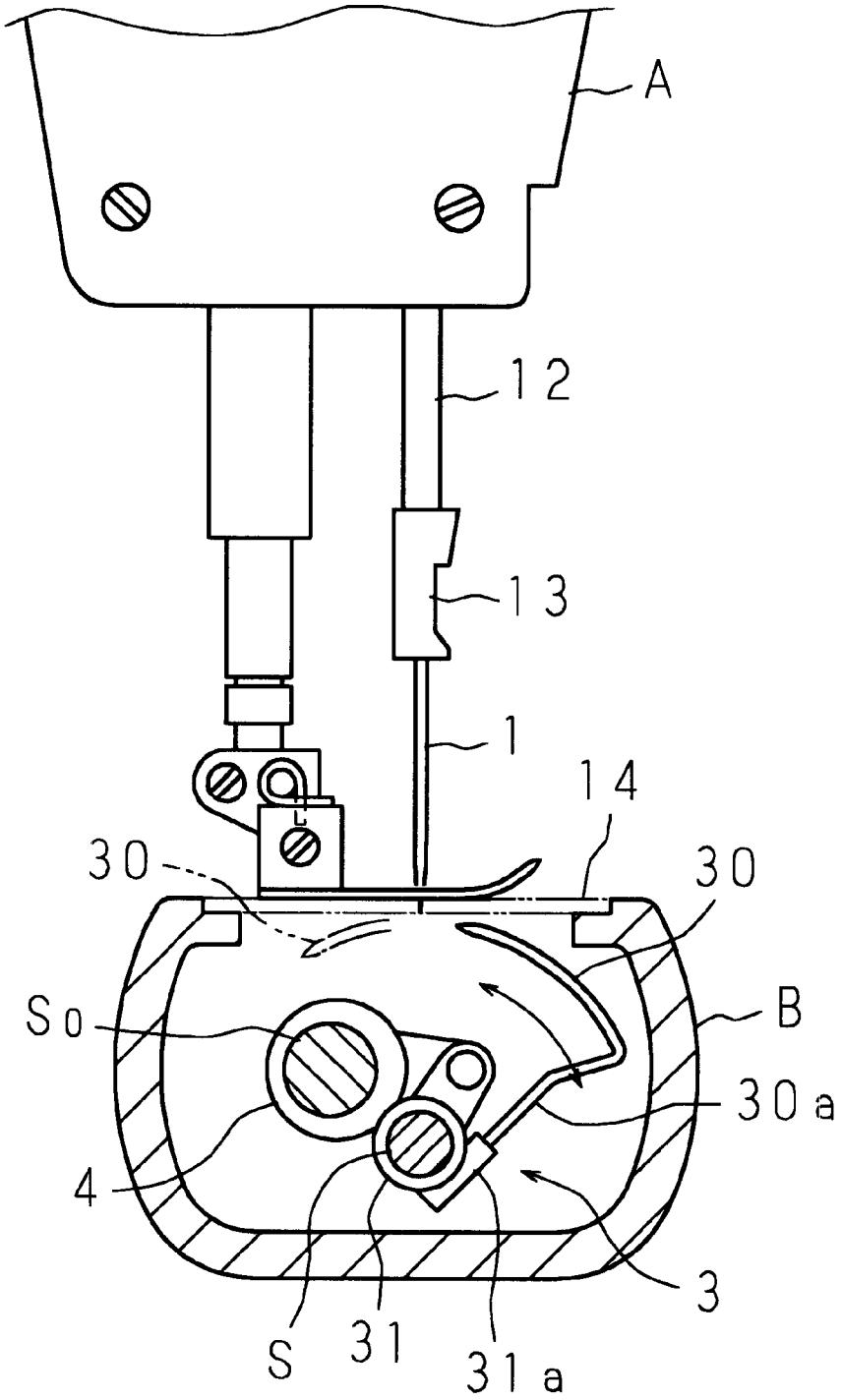
FIG. 2 is a side view showing an example of the drive mechanism for the retainer in the sewing machine shown in FIG. 1.

FIG. 2 is a left sectional view showing the entire construction of the retainer 3 for projecting and withdrawing the retainer rod 30 as mentioned above as well as the schematic construction of the sewing machine having this retainer 3. In the figure, A shows a sewing machine arm, and B shows a sewing machine bed. Needle bar 12 is supported in a manner enabling it to slide vertically on the tip end part of the sewing machine arm A that faces the upper portion of the sewing machine bed B at a proper distance. The needle 1 is attached to the tip end of the needle bar 12 facing the needle plate 14 put over the sewing machine bed B via needle stopper 13. The needle 1 moves up and down as mentioned above in accordance with the rise and fall of the needle bar 12.

The retainer 3 comprises retainer shaft S disposed inside the sewing machine bed B having a cylindrical section, retainer base 31 fitted with the retainer shaft S, and the retainer rod 30 attached on the retainer base 31. The retainer shaft S is laid below the needle plate 14 at a position at a proper distance from the needle plate 14 so that the lengthwise direction of the shaft is directed laterally, that is, in the direction roughly orthogonal to the direction of feeding of the cloth on the needle plate. The retainer shaft S is connected to the main shaft S0 laid inside the sewing machine bed B in parallel via a generally-known eccentric ring 4. The retainer shaft S rotates backward and forward by a predetermined angle around itself in accordance with the rotation of the main shaft S0.

The retainer rod 30 is a round bar member with a small diameter curving at a proper radius of curvature as shown in FIGS. 1A through 1D. A base part 30*a* extending to the inside in the direction of the radius of the curve is continuously provided on one end of the retainer rod 30. A fixed cylinder 31*a* with a small diameter is provided on the retainer base 31, to which the retainer rod 30 is attached, at one position of the outer circumference of the boss ring fitted to the retainer shaft S so as to extend roughly tangential to the base. The base part 30*a* of the retainer rod 30 is inserted into the fixed cylinder 31*a* of the retainer base 31 and fixed by a proper means such as a set screw or the like.

In the retainer 3 thus constructed, the retainer base 31 swings in the range of a predetermined angle in accordance with the backward and forward rotation of the retainer shaft S. By this swinging, the curved portion of the retainer rod 30 projects and withdraws within the plane roughly orthogonal to the retainer shaft S based on the shaft core of the retainer shaft S as a fulcrum. Furthermore, this retainer 3 has a cylindrical section as shown in the figure. The retainer 3 of the invention can be disposed and act even inside the sewing machine bed B where space is limited due to the provision of a feeding teeth (not shown) for feeding the cloth on the needle plate 14 and a mechanism for transmission to the looper 2. The retainer 3 of the invention can be applied regardless of the type of sewing machine.

The projection and withdrawal of the retainer rod 30 as mentioned above can be made to be performed along the lower surface of the needle plate 14 by adjusting the attachment position of the base part 30*a* onto the retainer base 31. Furthermore, the timings of the projection and withdrawal of the retainer rod 30, that is, the timing at which the retainer rod 30 projects to catch the looper thread 20 and the timing at which the catch of the looper thread 20 is released by withdrawing the retainer rod 30 after projecting it can be set by adjusting the attachment position of the retainer base 31 and changing the initial position of the retainer rod 30 on the circumference of the retainer shaft S. Furthermore, the projection and withdrawal of the retainer rod 30 can be freely set by adjusting the amount of eccentricity of the eccentric ring 4 that connects the retainer shaft S to the main shaft S0 and adjusting the moving stroke of the retainer rod 30.

In such setting in timings of the projection and withdrawal, in the case where the purpose of holding the looper thread 20 by the retainer rod 30 is taken into account, the timing of release of the catch of the looper thread 20 when the retainer rod 30 withdraws is important. This timing must be set so that the condition where the looper thread 20 is caught through the rearward projection of the retainer rod 30 is maintained at least until the tip end of the looper 2 projecting leftward crosses the rise path of the needle 1 in accordance with this projection. That is, the timing needs to be maintained until the time immediately before the condition in FIG. 1(D).

In a sewing machine provided with a plurality of needles 1, the release timing of the catch may be set in the same manner with respect to the needle 1 positioned apart from the looper 2. In addition, the catch timing of the looper thread 20 when the retainer rod 30 projects may be set within a range in which this catch can be performed. This setting is properly made by the abovementioned setting of the release timing of the catch in the construction in which the retainer 3 is made to move in connection with the main shaft S by means of the eccentric ring 4 as mentioned above.

Furthermore, the release timing of the catch is preferably set with a sufficient delay within a range that does not exceed the start point of right withdrawal of the looper 2 for the next catch if the timing is after the point at which the tip end of the looper 2 projecting leftward crosses the travel path of the needle 1. Particularly, as shown in the embodiment, in the sewing machine provided with a single needle 1, the binding of the looper thread 20 due to the tightening of the needle thread 10 tends to become insufficient. Therefore, to stably obtain the desired stitches shown in FIG. 3, it is desirable that the release timing is set with a slight delay.

Moreover, the main portion of the drive mechanism as mentioned above is constructed avoiding the lower side of the needle plate 14 where space is insufficient due to the provision of a mechanism for transmitting power to the looper 2 and feeding teeth 5. Only the retainer 3 with a small diameter needs to be disposed below the needle plate 14, so that the retainer 3 can be easily post-attached.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A sewing machine comprising:

at least one needle which moves up and down at a predetermined stroke penetrating a needle plate while holding a needle thread, and stick into a cloth on the needle plate when falling to catch a looper thread under the needle plate;

a looper which projects and withdraws laterally under the needle plate while holding the looper thread and catches the needle thread left at the fall position of the needle when projecting; and a retainer which projects and withdraws backward and forward within a plane under the needle plate roughly in parallel with the needle plate, and crosses the travel path of the looper when projecting rearward to catch the looper thread held by the looper at the projection side of the looper ahead of the needle, wherein the movement timing of the retainer is set so that the condition where the retainer catches the looper thread upon projecting rearward is maintained at least until the tip end of the looper that projects in accordance with the rise of the needle crosses the travel path of the needle.

2. A sewing machine according to claim 1, wherein the retainer including:

a retainer base which is disposed below the needle plate and swings backward and forward in accordance with power transmission from the sewing machine's main shaft; and a retainer rod which is fixed at its base part onto the retainer base and curves under the lower surface of the needle plate.

* * * * *